United States Patent [19]

Kapetanakos et al.

[11] 4,282,436

[45] Aug. 4, 1981

[54] INTENSE ION BEAM GENERATION WITH AN INVERSE REFLEX TETRODE (IRT)

[75] Inventors: Christos A. Kapetanakos, Bethesda, Md.; John A. Pasour, Alexandria, Va.; Redge A. Mahaffey, Clinton, Md.; Jeffry Golden, Laurel, Md.; Spencer J. Marsh, Oxon Hill, Md.

[73] Assignee: The United States of America as represented by the Secretary of the Navy, Washington, D.C.

[21] Appl. No.: 156,441

[22] Filed: Jun. 4, 1980

[51] Int. Cl.[3] ..... H01J 23/08

[52] U.S. Cl. ..... 250/423 R; 313/155; 313/192; 313/360

[58] Field of Search ..... 250/423 R, 427; 313/153, 155, 360, 192

[56] References Cited

U.S. PATENT DOCUMENTS

| | | | |
|---|---|---|---|
| 4,045,677 | 8/1977 | Humphries et al. | 250/423 R |
| 4,080,549 | 3/1978 | Creedon et al. | 313/192 |
| 4,087,721 | 5/1978 | Mourier | 313/209 |
| 4,126,806 | 11/1978 | Kapetanakos et al. | 250/423 R |
| 4,194,139 | 3/1980 | Pasour et al. | 250/423 R |

*Primary Examiner*—Bruce C. Anderson

*Attorney, Agent, or Firm*—R. S. Sciascia; William T. Ellis; Vincent J. Ranucci

[57] ABSTRACT

An inverse reflex tetrode (IRT) for producing an intense pulsed beam of ions includes a real cathode having a curved or conical surface which is substantially transparent to the ions; first anode and second anode, or grid, which are spaced apart and are at the same potential, the first anode being between the real cathode and the second anode and having a curved or conical surface approximately parallel to the surface of the real cathode, and also being formed from a dielectric material such as polyethylene; a curved or conical hollow anode stalk which supports both anodes; and a virtual cathode which is formed by electrons that are emitted by the real cathode and pass through the first anode. The real cathode and first and second anodes are enclosed in a vacuum chamber and are immersed in an applied external magnetic field. The IRT receives an electrical pulse from a high-voltage pulse generator. The real cathode emits electrons which accelerate toward the first anode, pass through the first anode and form a virtual cathode between the first and second anodes. Most of the electrons oscillate between the virtual cathode and the real cathode and form a plasma sheath on the surfaces of the first anode. Some ions from the plasma propagate toward the second anode, and some ions propagate toward the real cathode. The ions arrive at the second anode with zero velocity, while the other ions pass through the real cathode and form a propagating ion beam.

9 Claims, 7 Drawing Figures

INTENSE ION BEAM GENERATION WITH AN INVERSE REFLEX TETRODE (IRT)

BACKGROUND OF THE INVENTION

This invention relates generally to the generation and extraction of pulsed ion beams and more particularly to a low-inductance, inverse reflex tetrode (IRT) which produces an intense, unidirectional beam of ions having a low transverse temperature, operates with an essentially constant impedance, is highly efficient and independent from the value of an applied external magnetic field.

Existing sources of intense ion beams may be categorized as follows: (i) magnetically insulated diodes; (ii) pinched beam diodes; (iii) reflex triodes; and (iv) reflex tetrodes. In magnetically insulated diodes the efficiency is high but the ions must be accelerated perpendicular to an external magnetic field which exceeds the value required to suppress the electron flow. This strong magnetic field influences the orbits of ions and their propagation properties. Pinched beam diodes are characterized by a relatively high efficiency but fail to operate in the presence of an external magnetic field. Reflex triodes require an external magnetic field and their efficiency is relatively low. The efficiency of reflex tetrodes is high but only if immersed in an external magnetic field. In addition, at high power levels, the impedance of both triodes and tetrodes drops almost monotonically during their operation and thus they cannot be coupled to low impedance generators and operate with high efficiency. Finally, in both these two devices the ion beam is extracted through a virtual cathode, which, in general, is neither stationary nor parallel to an anode because the shape and position of a virtual cathode vary with time. As a result of the latter, the ions experience a radial electric field in the accelerating gap (between the anode and virtual cathode) and thus acquire a velocity transverse to the applied magnetic field (beam heating). In some instances an ion beam which is extracted through a virtual cathode is not current-neutralized. Extraction of an ion beam with small divergence and energy spread through a virtual cathode is difficult.

Stephanakis et. al. (Phys. Rev. Letter 37, 1543, 1976) have observed enhanced ion yields in a pinched-beam-diode ion source when an opaque carbon anode is replaced with a semitransparent foil. The slight yield enchancement has been attributed to the reflexing of electrons through the thin anode foil. The predominant mechanism responsible for the ion generation is the pinching of the electron beam. Since the pinching is suppressed by an external magnetic field, the pinched-beam-diode ion source is useful only in those applications that do not require an applied magnetic field.

Similarly, Creedon et. al. (U.S. Pat. No. 4,080,549, Mar. 21, 1978) have proposed a device for relexing electrons and producing a flow of ions which is internal to the device. This device has a very large inductance and thus cannot operate efficiently with low-impedance generators. Also, the device has no means for limiting electron losses within the structure of the device, nor for preventing electron pinched flow, nor any means for extracting an ion beam, particularly a low-transverse-temperature ion beam.

SUMMARY OF THE INVENTION

It is the general purpose and object of the present invention to provide a low-inductance source of ions that is compatible with low-impedance pulse generators for efficiently generating and extracting an intense, pulsed beam of ions insensitive to the value of an applied extenal magnetic field and for operating at an essentially constant impedance. This and other objects of the present invention are accomplished by a coaxial, low-inductance inverse reflex tetrode having a real cathode which has a curved or conical surface and is substantially transparent to ions, a first and a second anode, the first anode being formed from a single thin dielectric foil having a curved or conical surface that is approximately parallel to the surface of the real cathode, a positively pulsed, curved or conical anode stalk for supporting both anodes, the stalk being coaxial to and closely spaced from a surrounding grounded cathode support, and a virtual cathode that is formed during operation. The first anode is spaced between the real cathode and second anode. The first and second anodes are at the same potential. The system is immersed in an applied magnetic field and is enclosed in a chamber in which a vacuum is maintained. The thickness of the foil of the first anode may be varied to suit the value of the magnetic field. The distance between the first and second anodes may be adjusted for forming an optimum virtual cathode.

When the system receives an electrical pulse from a high-voltage pulse generator, the real cathode emits electrons which accelerate toward the first anode, pass through the first anode, and form a virtual cathode between the first and second anodes. Most of the electrons oscillate between the real and virtual cathodes until the electrons are absorbed in the first anode and form a plasma thereon. Ions are extracted out of the plasma. The ions which travel in the direction of the second anode pass through the virtual cathode and reach the second anode with zero velocity. The ions which travel toward the real cathode pass through the real cathode and form a propagating ion beam.

The novel features of the present invention include a coaxial, low-inductance configuration comprising a real cathode which has a curved or conically-shaped surface, is substantially transparent to ions and is mounted on a grounded cathode support; positively, pulsed first and second anodes, the first anode being a single, thin film of dielectric material having a curved or conical shape that is approximately parallel to the real cathode; a hollow anode stalk for supporting the first and second anodes and for enclosing a virtual cathode, the anode stalk being shaped to avoid intersecting field lines of an applied magnetic field, the magnetic field being applied to avoid pinching of an internal flow of electrons at high-power operation, the anode stalk also being closely spaced from, coaxial with, and surrounded by the cathode support. Ions, from a plasma on the surface of the first anode, which are accelerated by the positive potential that is applied to the anodes, propagate through the real cathode and form a drifting ion beam.

The advantages of the present invention over the prior art are: an intense, unidirectional ion beam; low inductance; constant impedance during an appreciable portion of the applied voltage pulse; high efficiency even when the applied magnetic field exceeds the self field; extraction of an ion beam through a real cathode having a stationary and well-defined surface so that (1) the beam is almost completely (typically greater than 90 percent) current-neutralized, (2) the beam may be solid as well as annular, (3) the extracted beam is a colder beam, that is, the beam has a lower transverse temperature and higher beam quality, and (4) by suitably selecting curvatures or cone angles for the first anode and real cathode, a convergent, divergent, or cylindrical beam of ions can be produced and extracted.

Other objects and advantages of the invention will become apparent from the following detailed description of the invention when considered in conjunction with the accompanying drawing wherein:

DETAILED DESCRIPTION OF THE INVENTION

Figure 1:
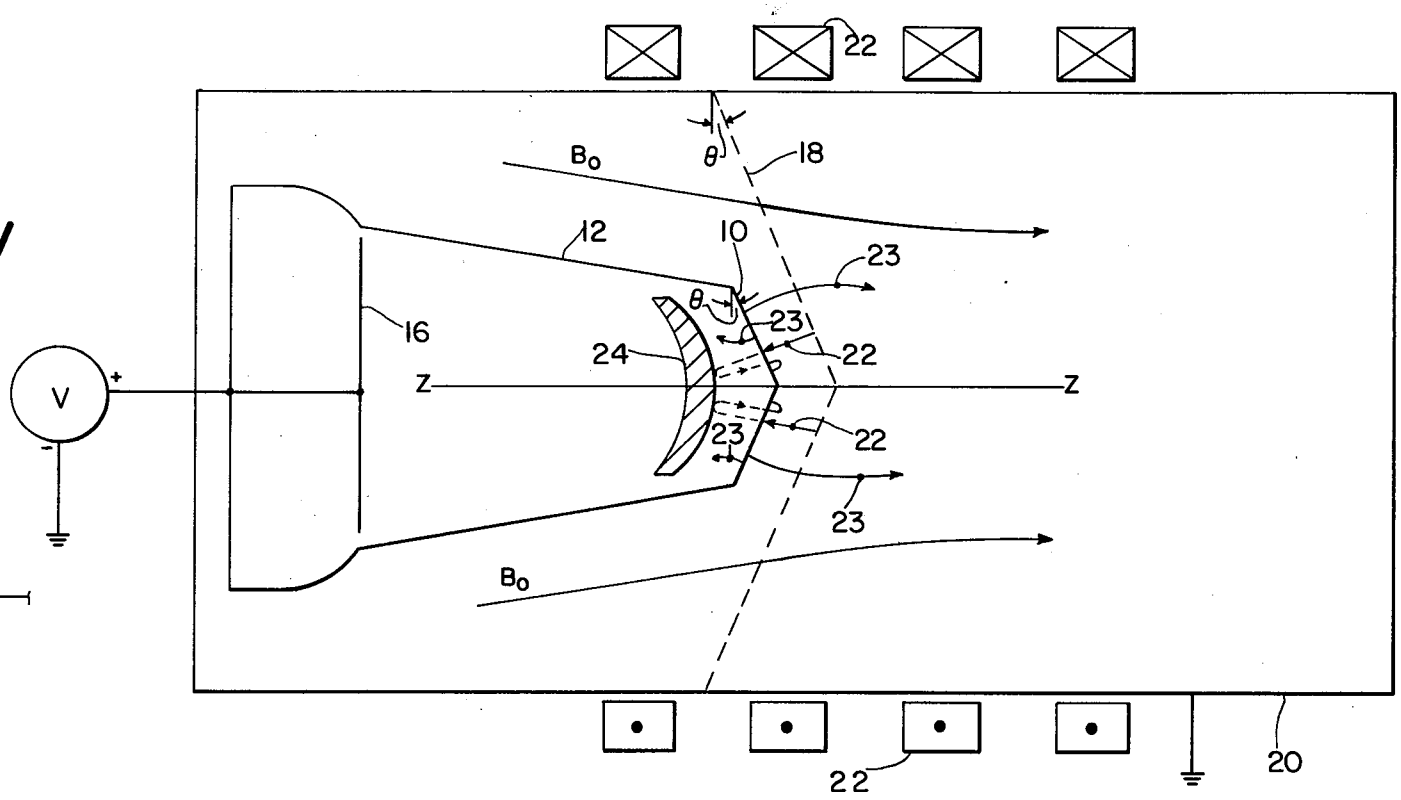
FIG. 1 is a schematic illustration of an embodiment of the present invention coupled to an external generator.

Referring now to the drawing, FIG. 1 shows a first anode 10 which is curved or conically-shaped and comprises a thin foil that is formed from a dielectric material such as polyethylene, MYLAR, TEFLON, KAPTON, polycarbonate, or parylene. The thickness of the first anode 10 is typically in the range of 1 $\mu$m to 1000 $\mu$m where the thickness is chosen to be much less than the range of an electron accelerated through the applied potential so that the reflexing electrons can make a large number of transists through the anode material. However, the material must be of sufficient thickness so that the reflexing electrons do not make so many transits that a current-bootstrapping effect preciptously drops the voltage and, thus, the ion-production efficiency. The choice of first anode material determines the species of ions in the ion beam. The anode 10 is attached to one end of an electrically-conducting, hollow, curved or conically-shaped anode stalk 12. The other end of the anode stalk 12 includes an electrically-conducting back plate which forms a second anode 16. The second anode 16 is suitably coupled to the anode stalk 12 so that the second anode 16 may be moved along the axis Z of the device for adjusting the distance between the first and second anodes, as will be discussed more fully hereinafter. A grounded cathode 18 is spaced from and approximately parallel to the first anode 10. The cathode 18 has a curved or conically-shaped surface and is formed from an electrically-conducting mesh, or thin foil, such as stainless steel screen, so that the cathode is substantially transparent to ions. The cathode must be generally transparent for allowing ions to pass therethrough, yet the cathode must also form a uniform electric field on its surface facing the first anode, that is, within the gap between the cathode and first anode, for suitably emitting electrons. Typically, the open area of the cathode 18 exceeds fifty (50) percent of the cathode area which is adjacent to the first anode 10.

The anodes 10 and 16, anode stalk 12 and cathode 18 are enclosed within a grounded chamber 20, which may also serve as a grounded cathode support, in which a vacuum below $10^{-3}$ Torr is maintained. The chamber 20 includes a drift region 21 and is fabricated from any material, such as stainless steel, brass, or aluminum, which will hold a vacuum.

The chamber 20, hollow anode stalk 12, and second anode 16 must be thin enough so that any pulsed, applied magnetic field will penetrate into the interior of the hollow anode stalk. An especially well-suited material for this requirement is stainless steel. The positive terminal of a high-voltage pulse generator 14 suitably passes through a wall of the chamber 20 and connects to the second anode 16 and to the anode stalk 12. An axial magnetic field $B_o$ is suitably supplied by pulsed solenoidal magnets 22. The walls of the anode stalk between the first and second anodes do not intersect the fringing magnetic field lines. Also, $B_o$ is substantially parallel to the axis Z of the device in the drift region 21. The thickness of the foil which comprises the first anode may be varied to suit various values of $B_o$, as will be discussed more fully hereinafter.

Any high-voltage generator, which is capable of producing a large positive voltage pulse within the range of 0.1 megavolts to several megavolts, may be utilized with the present invention. The duration of the pulse must be long enough for forming a virtual cathode and for producing plasma on the first anode 10, and may be as long as the time over which the impedance of the system does not change significantly. For first anode 10 to real cathode 18 spacings of 0.1 cm–10.0 cm, this pulse duration may be in the range of 1 nanosecond to 10 microseconds.

Figure 2:
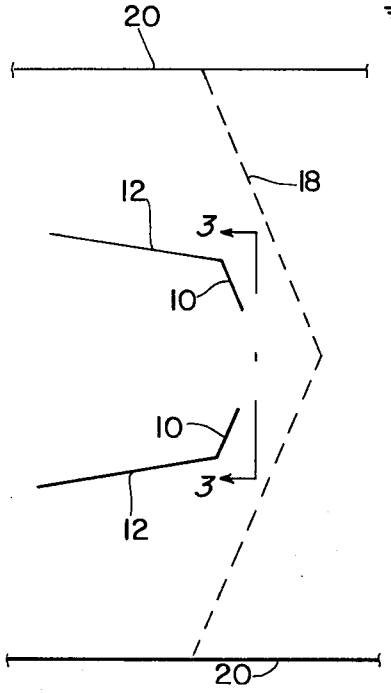
FIG. 2 is a schematic illustration of a second embodiment of an anode shown in FIG. 1.
Figure 3:
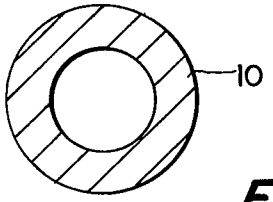
FIG. 3 is a side view of the anode shown in FIG. 2.

The first anode 10, as shown in FIG. 1 is conically shaped and produces a solid beam of ions. For forming a hollow beam of ions, the first anode is shaped as shown in FIG. 2, that is, a portion of the cone about its axis, including the vertex, is removed so that the first anode is annular, as shown in FIG. 3. Although a conically-shaped first anode and cathode, is shown in FIGS. 1 and 2, the first anode and cathode may be any shape that forms a desired ion beam, such as a convergent, or divergent or cylindrical beam. However, the distance between the first anode and cathode must be uniform. For example, to produce a slightly convergent beam, the first anode and cathode may have flat surfaces that are perpendicular to the axis of the anode stalk.

In general, the first anode and real cathode may have curved surfaces. The purpose of tapering or curving these electrodes is to counter the radial inward forces experienced by the ions as they cross the gap between the first anode and real cathode. These forces are, in part, the result of the axial motion of the ions in the azimuthal self-magnetic field produced by the current flowing in the gap and also in part the result of a net accumulation near the axis of electron space charge within the gap. By using a conical first anode and real cathode or curved electrodes, an outward or inward radial component of electric field may be introduced in the gap when the positive potential pulse is applied to the anodes. When conical electrode shapes are used, the cone angle $\theta$ required to provide sufficient outward radial electric field to balance the inward magnetic force and produce a cylindrical beam with low transverse temperature is given approximately by $$\theta = \arcsin \frac{d}{V_o \tau} \int_0^d B_\theta \, dz \quad (1)$$

where d is the length of the gap between the first anode and the real cathode, $V_o$ is the applied potential, Z is the axial coordinate, $\gamma$ is the ion transit time across d, and $B_\theta$ is the self-magnetic field of the current flowing in the gap evaluated at the outer radius of the first anode. In the above expression, the azimuthal motion of the ions has been neglected, and the ion transit time may be estimated as $$\tau \sim d\sqrt{\frac{2M}{QV_o}} \quad (2)$$

where M is the ion mass and Q is the ion charge.

When a convergent or divergent beam is required, other cone angles or curvature of the first anode and real cathode may be employed to provide the appropriate radial electric field, that is, inwardly or outwardly directed, to impart the needed radial velocity. Because the device operates with nearly constant impedance during most of the pulse, the relative balance between the radial electric field resulting from the shaped electrodes and the electric and magnetic self-forces within the gap does not change greatly during the pulse.

To account for large radial variation in the current density and charge density in the gap which can produce a large radial variation in the electric and magnetic self-forces, the first anode and cathode need not have the same cone angle or may be curved so that the angle $\theta$ in Equation (1) should be defined as the angle between the axis and a unit vector which is normal to the electrode surfaces at a given radial position, and $B_\theta$ is the value of the azimuthal self-magnetic field at that radial position. Although the anode-cathode gap may vary with radial position, ideally at a given radius there should be no variation in the gap rotationally about the Z axis.

The anode stalk may be any shape which satisfies a desired application, but for optimum performance the walls of the anode stalk should closely parallel the fringing lines of the magnetic field $B_o$, as previously mentioned. Thus, for example, the anode stalk may be cylindrical rather than tapered as shown in FIGS. 1 and 2, or may have a curved, axisymmetric shape to avoid crossing the field lines of the magnetic field $B_o$.

In operation, a high-voltage, positive pulse from the generator is applied to the first and second anodes, the anodes being at the same potential. Electrons 22 are emitted from the cathode, pass through the first anode, and form a virtual cathode 24 between the first and second anodes. Some of the electrons pass through the virtual cathode and reach the second anode. The other electrons oscillate between the real and virtual cathodes and through the first anode until the electrons are absorbed in the first anode and form a plasma thereon. Some of the electrons are lost to the walls of the anode stalk. Ions 23 are extracted from the plasma on the first anode. When the applied voltage is increasing or unchanging, ions directed toward the virtual cathode are unable to reach the second anode or reach the second anode with zero velocity. Thus, these ions do not represent an energy drain on the system. However, most of the ions directed toward the real cathode pass through the real cathode and form an intense, propagating ion beam.

Figure 4:
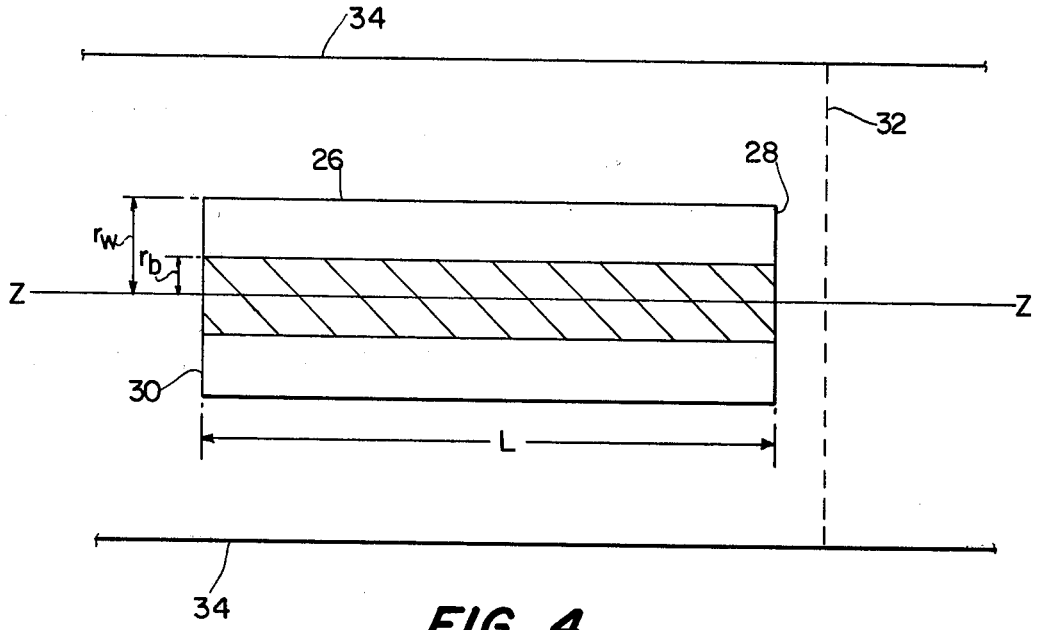
FIG. 4 is a schematic illustration of a portion of a second embodiment of the present invention.
Figure 5:
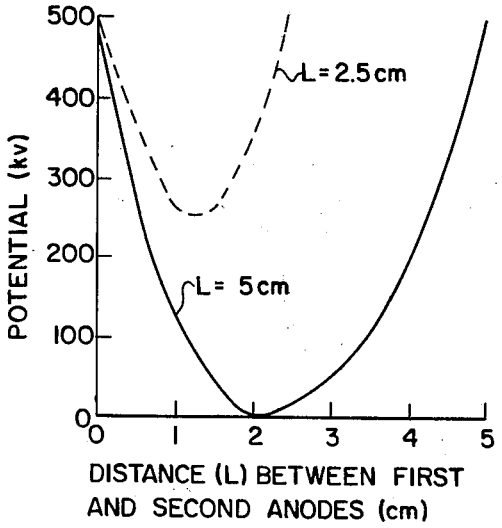
FIG. 5 is a graph illustrating the variation of potential with axial position in the space between the first and second anodes.

Formation of the virtual cathode depends upon the uncompensated space charge distribution within the anode stalk and the boundary conditions at the walls of the anode stalk as described in Naval Research Labroatory Memorandum Report 4103, "Intense Ion Beam Generation with an Inverse Reflex Tetrode (IRT)", by J. A. Pasour, R. A. Mahaffey, J. Golden, and C. A. Kapetanakos, Oct. 18, 1979 which is available from National Technical Information Service, Order Number ADA 075747, herein incorporated by reference, and "High-Power Ion Beam Generation with an Intense Reflex Tetrode" by J. A. Pasour, R. A. Mahaffey, J. Golden, and C. A. Kapetanakos, Appl. Phys. Lett. 36 (8), Apr. 15, 1980, also herein incorporated by reference. For analytical simplification the configuration of the first and second anodes, 10 and 16 respectively, real cathode 18, and anode stalk 12 of FIG. 1 is modified as shown in FIG. 4 so that the anode stalk 26 is cylindrical, and the first and second anodes, 28 and 30 respectively, and real cathode 32 are flat, circular, and perpendicular to the axis Z of the device. Part of a vacuum chamber 34 is also shown. For the configuration as shown in FIG. 4, the voltage potential along the axis Z of the anode stalk is shown in FIG. 5 (the axial position of O corresponds to the first anode and increases in length toward the second anode) as a function of the distance between the first and second anodes for a radially uniform net electron charge density of radius $r_b$=2.5 cm which is located inside the anode stalk having a radius $r_w$=5 cm. A virtual cathode forms when the potential becomes zero at a point along the axis Z. Thus, FIG. 5 discloses that when the distance L between the first and second anodes is too small, for example 2.5 cm, no virtual cathode forms. However, if L is 5 cm, a virtual cathode forms approximately 2 cm from the first anode, the point along the axis Z at which the potential is zero.

Figure 6:
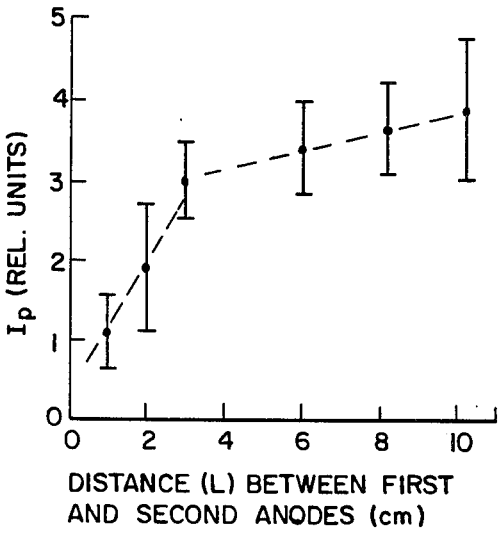
FIG. 6 is a graph illustrating the variation of the number of protons with axial spacing between the first and second anodes.

The number of ions that the system produces is also affected by the distance between the first and second anodes. FIG. 6 shows the number of protons (protons being the type of ions which are produced when a polyethylene first anode is employed) which are produced by a system having a configuration as shown in FIG. 4, for different distances between the first and second anodes.

Figure 7:
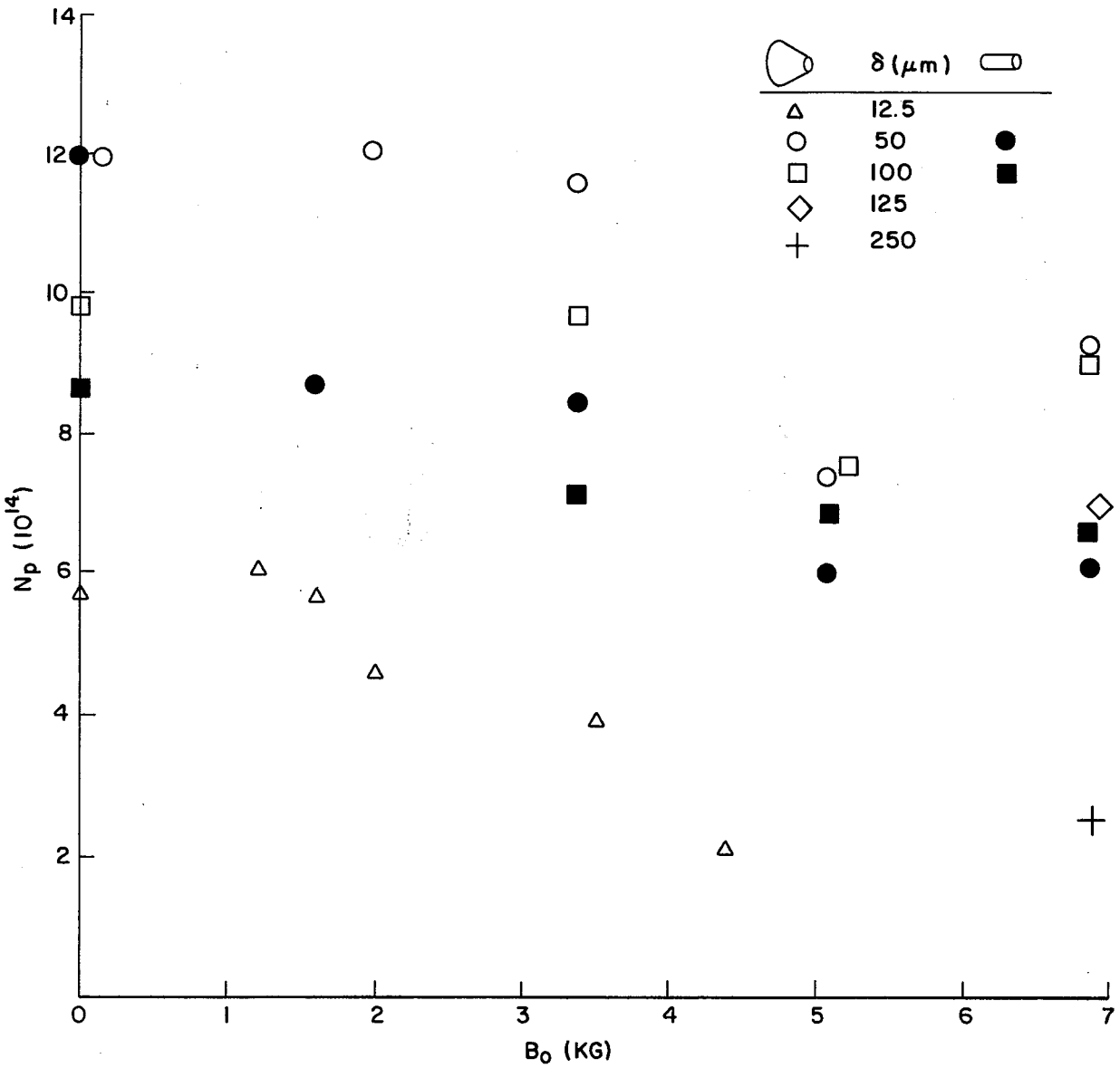
FIG. 7 is a graph illustrating the variation of the number of protons with applied magnetic field for different thicknesses of the first anode and for conical and cylindrical stalks which support the first and second anodes.

The number of protons $N_P$ which are extracted from the present invention is relatively insensitive to the applied magnetic field $B_o$, as shown in FIG. 7, if the foil of the first anode has an appropriate thickness. FIG. 7 illustrates the variation of the number of protons $N_P$ with the magnetic field $B_o$ for various thicknesses $\delta$ of anode foils for both conical and cylindrical anode stalks. In each case the distance between the first and second anodes is about 7.5 cm. The conical anode stalk generally provides a greater number of protons than the cylindrical stalk possibly due to higher electron losses to the cylindrical stalk along the magnetic field lines which fringe the walls of the stalk. Also, too thin (12.5 $\mu$m) or too thick (250 $\mu$m) an anode foil hinders production of protons, especially at higher magnetic fields.

Obviously many more modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. An inverse reflex tetrode receiving an electrical pulse from a pulse generator for producing and extracting a beam of ions comprising:

chamber means connected to said pulse generator for maintaining a vacuum;

a grounded cathode, coupled to said chamber means, said cathode having a curved surface and being formed from an electron-emitting material that is generally transparent to said ions;

means for supporting said cathode, said means being formed from an electrically-conducting material and being coupled to said pulse generator;

a first anode having a curved surface and being spaced apart from and approximately parallel to said cathode, said anode being formed from a generally electron-transparent, dielectric, foil material which forms a plasma that contains the ions when struck by said electrons;

a second anode spaced apart from said first anode, the first anode being disposed between said cathode and said second anode, said first and second anodes being at the same electrical potential; and a hollow anode stalk, a first end of said anode stalk supporting said first anode, and a second end of said anode stalk supporting said second anode, the anode stalk being coaxially aligned with and closely spaced from and surrounded by said cathode supporting means for providing low electrical inductance operation, the distance between said first and second anodes being sufficient for forming a virtual cathode therebetween, said first and second anodes and said anode stalk being electrically connected and coupled to said generator and receiving a high-voltage positive pulse from said generator so that electrons are emitted from the cathode, said electrons generally passing through the first anode and forming a virtual cathode between the first and second anodes, the electrons generally reflexing between said cathode and virtual cathode until the electrons are absorbed in the first anode and form a plasma thereon, said plasma emitting ions which propagate through the cathode.

2. An inverse reflex tetrode as recited in claim 1, wherein said tetrode comprises means for providing an applied, essentially axial magnetic field.

3. An inverse reflex tetrode as recited in claim 1, wherein said electron-emitting material of said cathode is a metallic screen.

4. An inverse reflex tetrode as recited in claim 1, wherein said electron-emitting material of said cathode is a thin, electrically-conducting foil.

5. An inverse reflex tetrode as recited in claim 1, wherein the thickness of said dielectric, foil material is substantially less than the range of an electron that is accelerated through the applied potential so that a reflexing electron can penetrate the anode material several times without causing the impedance of said tetrode to be reduced precipitously during the applied pulse.

6. An inverse reflex tetrode as recited in claim 1, wherein said means for supporting said cathode is the chamber means.

7. An inverse reflex tetrode as recited in claim 2, wherein the portion of the anode stalk that is between the first and second anodes does not intersect field lines, of said applied magnetic field, which pass through the first anode.

8. An inverse reflex tetrode as recited in claim 2, wherein said anode stalk is conical.

9. An inverse reflex tetrode as recited in claim 2, wherein said anode stalk is curved.

* * * * *